United States Patent [19]

Thiene, deceased et al.

[11] 4,024,813

[45] May 24, 1977

[54] CARD PRINTING MACHINE

[75] Inventors: Carl G. Thiene, deceased, late of Rosemead, Calif., by Carol M. Thiene, executrix; Henry Smith, Canoga Park, Calif.

[73] Assignee: Reynolds Printasign Company, Pacoima, Calif.

[22] Filed: Sept. 22, 1975

[21] Appl. No.: 615,350

Related U.S. Application Data

[60] Continuation of Ser. No. 418,242, Nov. 23, 1973, abandoned, which is a division of Ser. No. 258,186, May 30, 1972, Pat. No. 3,804,014.

[52] U.S. Cl. ..... 101/269; 101/354; 101/357

[51] Int. Cl.[2] ..... B41F 31/00

[58] Field of Search ..... 101/269–274, 101/250, 348–352, 247, 353–358

[56] References Cited

UNITED STATES PATENTS

| | | | |
|---|---|---|---|
| 1,635,297 | 2/1927 | Weide | 101/354 X |
| 1,898,605 | 2/1933 | Vandercood et al. | 101/355 |
| 2,181,714 | 11/1939 | Vandercook et al. | 101/354 |
| 3,087,422 | 4/1963 | Harding | 101/357 X |
| 3,348,481 | 10/1967 | Nowak | 101/269 X |
| 3,374,733 | 3/1968 | Goodrich | 101/354 X |

*Primary Examiner*—Edward M. Coven
*Attorney, Agent, or Firm*—Christie, Parker & Hale

[57] ABSTRACT

A machine particularly adapted for printing card stock. A head or carriage is mounted to reciprocate over a type bed. The carriage mounts the impression roller, inking rollers, doctor roller and an oscillating roller. The impression roller is mounted on an adjustable eccentric shaft adjustable to compensate for different thicknesses of card stock to thereby control the printing pressure. The impression roller is driven through roller members that move on rails which are coupled by way of a positive clutch to the ends of the impression roller which is positively driven in any adjusted position. The inking rollers, oscillating and doctor roller are mounted between side plates of the carriage, improved means being provided for lifting the inking rollers and for lifting the oscillating roller and doctor roller.

14 Claims, 11 Drawing Figures

FIG. 2.
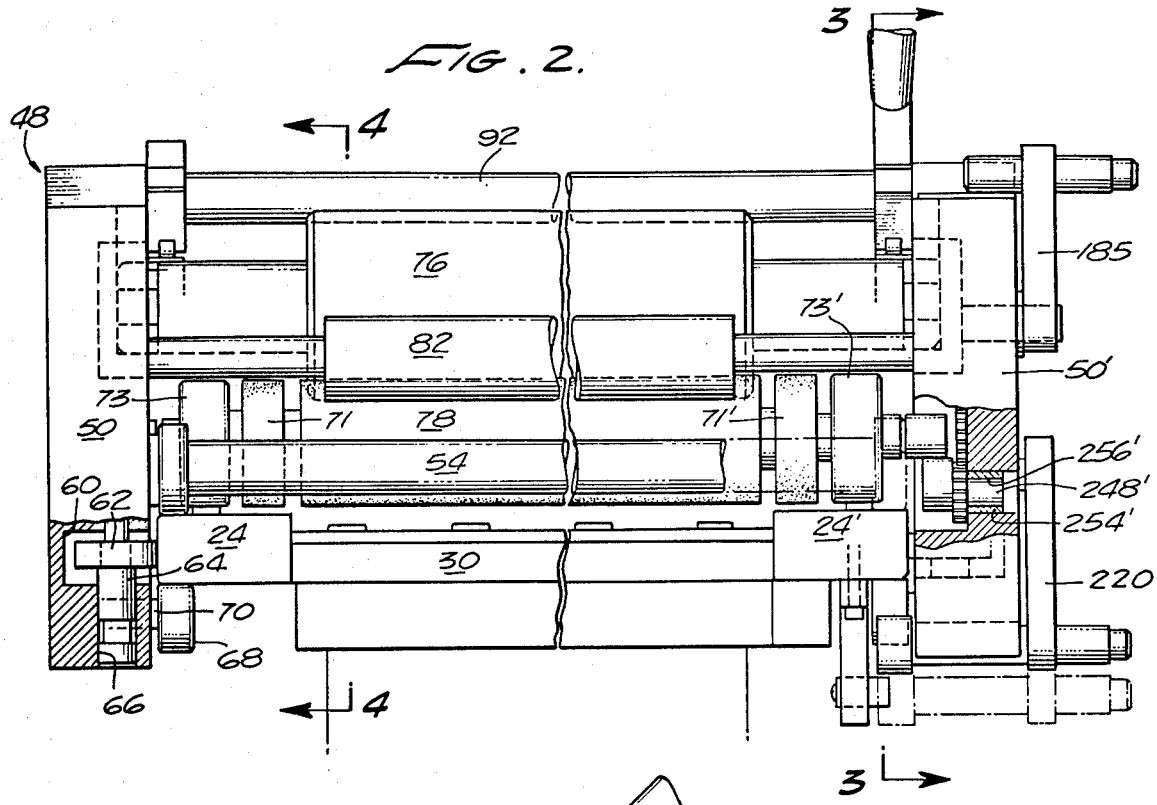
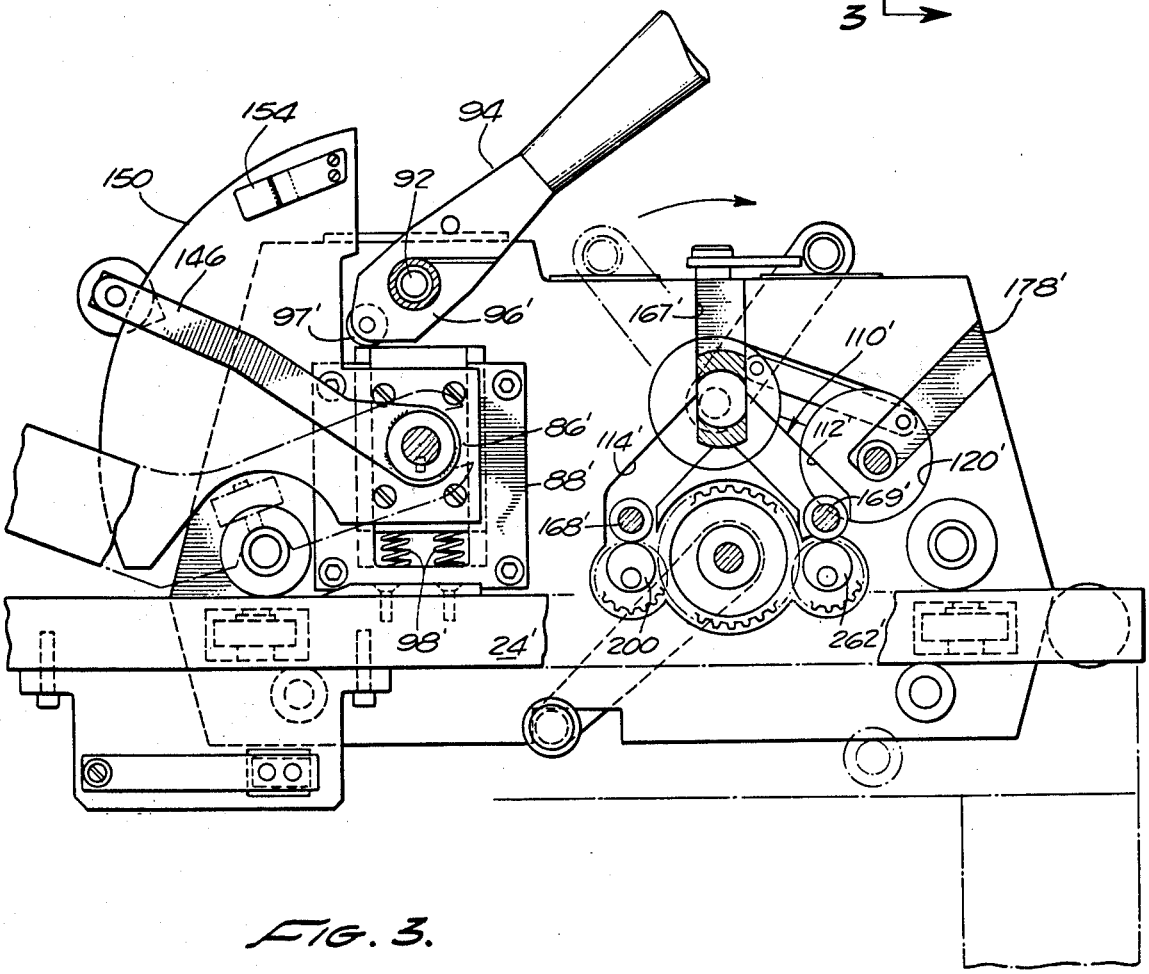
FIG. 3.

CARD PRINTING MACHINE

This application is a continuation of Ser. No. 418,242 filed Nov. 23, 1973 now abandoned, which is a division of Ser. No. 258,186 filed May 30, 1972 now, U.S. Pat. No. 3,804,014.

SUMMARY OF THE INVENTION

The invention is an improved printing machine of the type particularly adapted for printing signs on card stock. The machine provides a platform having a bed in which the type is set. A movable head or carriage is provided which reciprocates over the type bed, the carriage having rollers engageable with rails at the sides of the type bed.

The carriage carries an impression roller, an oscillating roller, inking rollers and a doctor roller. Particular improved means are provided for accurately adjusting the position of the impression roller with respect to the type bed in order to be able to compensate for varying thicknesses of card stock thus to print with controlled pressure. Improved means are also provided for assembling the inking rollers, oscillating roller and doctor roller in the head or carriage. Improved means are also provided for holding these rollers in position, for lifting the inking rollers out of inking position and for raising the oscillating roller and doctor roller into an inactive position.

A primary object of the invention is to provide improved means for positioning the impression roller to compensate for card stock thickness and for positively driving the impression roller.

A further object is to provide improved drive means for the impression roller comprising coupling clutches between ends of the impression roller and drive rollers providing for positive drive of the impression roller at the same speed as the drive rollers in any adjusted position of the impression roller.

Another object is to provide lifting means for the inking rollers comprising eccentric cams on which the ends of the inking rollers rest, the cams being adjustable to raise and lower the inking rollers.

Another object is to provide an improved holding and lifting means for the oscillating roller and doctor roller in the form of rotatable tumblers mounted in the side plates of the carriage, the tumblers having slots to receive the ends of the shafts of the oscillating and doctor roller so that these rollers can be lifted by rotating the tumblers.

BRIEF DESCRIPTION OF THE DRAWINGS

Further objects and additional advantages of the invention will become apparent from the following detailed description and annexed drawings wherein:

FIG. 2 is an end view partly in section of the head or carriage assembly;

FIG. 3 is a sectional view taken along the line 3—3 of FIG. 2;

GENERAL ORGANIZATION OF THE MACHINE

Figures 1, 10:
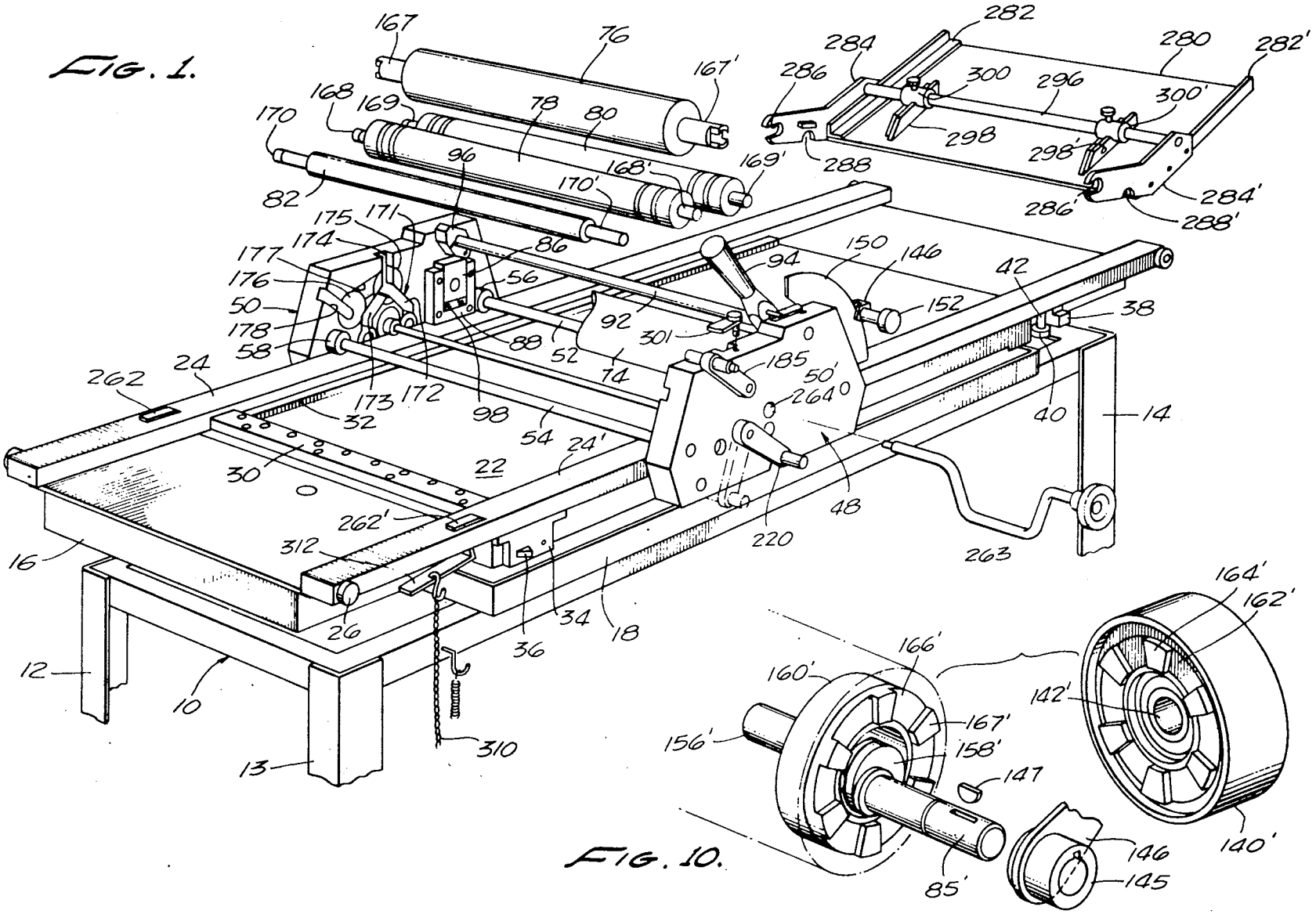
FIG. 1 is a partially exploded perspective view of the machine.
FIG. 10 is an exploded perspective view of the eccentric adjustment of the impression roller which compensates for card thickness showing the coupling or clutch between the drive rollers and the impression roller and FIG. 11 is a transverse sectional view taken substantially along line 11—11 of FIG. 5.

The general organization of the machine is shown in the perspective view of FIG. 1 which will be described first followed by a description of the main subassemblies.

Numeral 10 designates a rectangular frame which is part of a supporting stand for the machine there being corner legs, three of which are shown at 12, 13 and 14. The machine has a rectangular supporting base or platform 16 supported over the stand 10. Numeral 18 designates a sub base underneath the base 16.

Supported on the base 16 is the bed 22 in which the individual type pieces are set as will be described. At the sides of the bed 22 are the rails 24 and 24'. At the ends of these rails on the outside are stops one of which is designated at 26 there being one at each corner. Numeral 30 designates a transverse bar at one end of the bed in which the type pieces are set. Along the sides of the area in which the type pieces are set are provided vertically slotted rails one of which is shown at 32. Type holding bars can be positioned transversely in the bed, their ends held in the slots and then with the type pieces held on the bars in a manner already known in the art.

Opposite the end of the transverse bar 30 and underneath the rail 24' is a bracket 34 having an extending cam 36 the purpose of which will be referred to presently.

Near the right end of the rail 24' and underneath it there is an extending bracket or dog 38 and a knob 40 on stem 42 the purposes of which will be described more in detail presently.

THE TRAVELING CARRIAGE

The traveling head or carriage of the machine is also shown in FIG. 2 and the subassemblies that it carries are shown in more detail in the other cross-sectional views. The head or carriage 48 is movable manually along the rails 24 and 24' of the machine to the left and right. The type pieces set in the bed are inked when the carriage 48 is manually moved to the left and the card stock is inked when the carriage 48 is moved to the right as will be described in more detail presently.

The carriage 48 comprises two similar side plates 50 and 50' as shown. The side plates 50 and 50' are held in assembled relationship by transverse spacer bars as designated at 52 and 54 and at the ends of which are bearings 56 and 58 as shown. The carriage 48 travels on the side rails 24 and 24' as shown in FIG. 2. In the side plates 50 and 50' are cutouts at the lower part of the plates one of which is designated at 60 in FIG. 2, there being four of these cutouts. Disposed in the cutout 60 is roller 62 on shaft or stem 60 journaled in a bore 66. Roller 62 rides against the side of rail 24 the other three rollers having corresponding relative positions. Numeral 68 designates a further roller on a horizontal shaft 70 extending from the inside of side plate 50. This roller engages the underside of the rail 24 as shown. Three other similar corresponding rollers are provided.

The carriage 48 carries a number of rollers as may be best seen in FIG. 1. Roller 74 is the impression roller which presses the card stock against the inked type as will be described. Roller 76 is an oscillating roller that distributes the ink evenly and uniformly over inking rollers 78 and 80 as will be described more in detail presently. Numeral 82 designates a doctor roller. The relative positions of these various rollers in position in the carriage 48 can be seen in FIG. 2, and in the cross-sectional view FIG. 4. The inking rollers are alike. Roller 78 has end tires 71 and 71′ and end collars 73 and 73′. The inking rollers have resilient tires 77 and 79. See FIG. 4.

THE IMPRESSION ROLLER ASSEMBLY

The impression roller can be lifted away from the card stock and also pressed down against it. It has a rubber tire 75. See FIG. 5. Numerals 85 and 85′ designate shaft ends journaled in vertically movable slide blocks 86 and 86′, which can slide vertically in slide members, the block 86 being slidable in a channel formed in U-shaped channel member 88 on the inside surface of side plate 50. The slide block at the other end is similar. See FIGS. 1, 3 and 5. Numeral 92 designates a cam actuating shaft actuatable by manual operating handle 94. At the ends of shaft 92 are cam members one of which is shown at 96 having the shape as shown with beveled end parts, one end of the cam member 96 having a roller 97 engageable with the slide block 96 to move it vertically against springs 98. By swinging the operating handle 94 the impression roller 74 can be moved down into engagement with the card stock or lifted from it.

Figure 7:
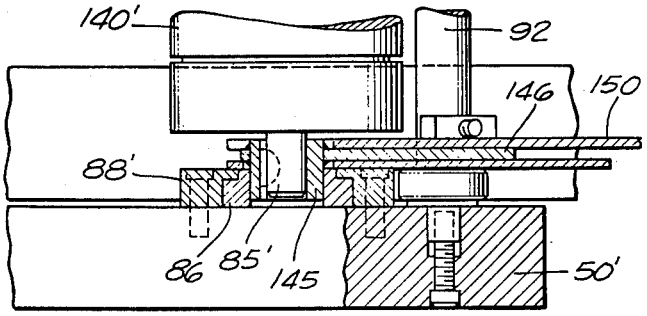
FIG. 7 is a detail view taken along the line 7—7 of FIG. 5.

At the ends of impression roller 74 are rollers designated at 140 and 140′. These rollers roll on the rails 24 and 24′ and rotate the impression roller. The roller 140′ is shown in detail in FIG. 10. It has a center hub part carrying bearing 142′ that is journaled on shaft 85′ on the end of which is carried bushing 145 at the end of the adjusting arm or handle 146 which moves adjacent arc segment 150 as may be seen in FIG. 3 and with respect to which it can be adjusted and set by means of knob 152. See FIGS. 1 and 7. Numeral 154 designates a flexible clip at an end position of the arm 146. Bushing 145 is journaled in block 86′ and is keyed to shaft 85′ by Woodruff key 147.

The shaft 85′ extends from an eccentric member 158; the shaft 156′ being eccentric with respect to the shaft 85′ on which the roller 140′ is journaled. Numeral 160′ designates a rotor journaled on the member 158′ to be rotatable on bearing 161′ about the center of the shaft 156′. As described, roller 140′ rides on the rail 24′.

On the inside surface of the roller 140′ there is provided an insert 162′ formed of composition material and having angularly spaced trapezoidal teeth or wedges as designated at 164′ with spaces in between them. The rotor 160′ carries a similar disk or insert member 166′ having similar angularly spaced trapezoidal shoes or wedge portions 167′ with angular spaces in between them. The composition inserts as just described provide for a drive coupling between the roller 140′ and rotor 160′. The roller 140′ drives the rotor 160′ in rotation as roller 140′ rolls on rail 24′. That is the teeth or wedges on the surface of one interengage between the teeth or wedges on the other. Shaft 85′ can be rotated about its axis by the adjusting arm 146. This of course adjusts the eccentric member 158′ and adjusts the vertical position of the shaft 156′ of the impression roller over or with respect to the type set on the bed of the machine. This adjustment is to compensate for variation in thickness of the card stock being printed and is a very important aspect of the invention it being very important that the pressure exerted on the card stock being printed be controlled. As explained the roller 140′ rotates the rotor 160′ and it is able to do this in any vertical adjusted position of shaft 156′. The angular spacing between the shoes or wedges on the coupling surfaces allow for the eccentric adjustment of shaft 156′ at least one of the wedges on the driving surfaces remaining in driving engagement without any lost motion in the coupling. The said coupling provided is a very great advantage as respects known types of friction couplings which allow for sliding. The impression roller 74 is rotated at the same speed as the roller 140′. The construction at opposite ends of impression roller 74 is the same other than as described in the foregoing.

Figures 4, 5, 11:
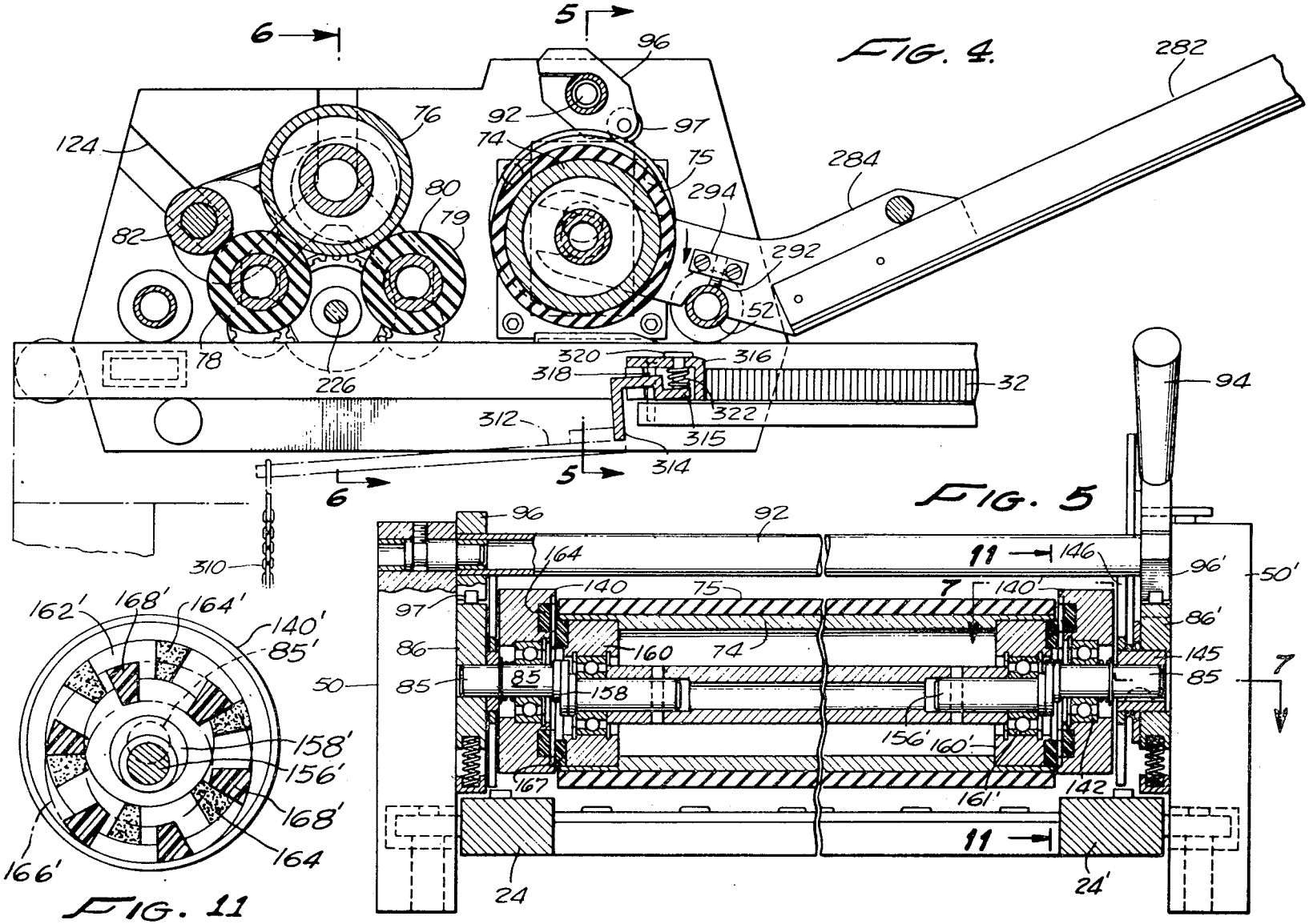
FIG. 4 is a sectional view taken along the line 4—4 of FIG. 2.
FIG. 5 is a sectional view taken along the line 5—5 of FIG. 4.
Figure 6:
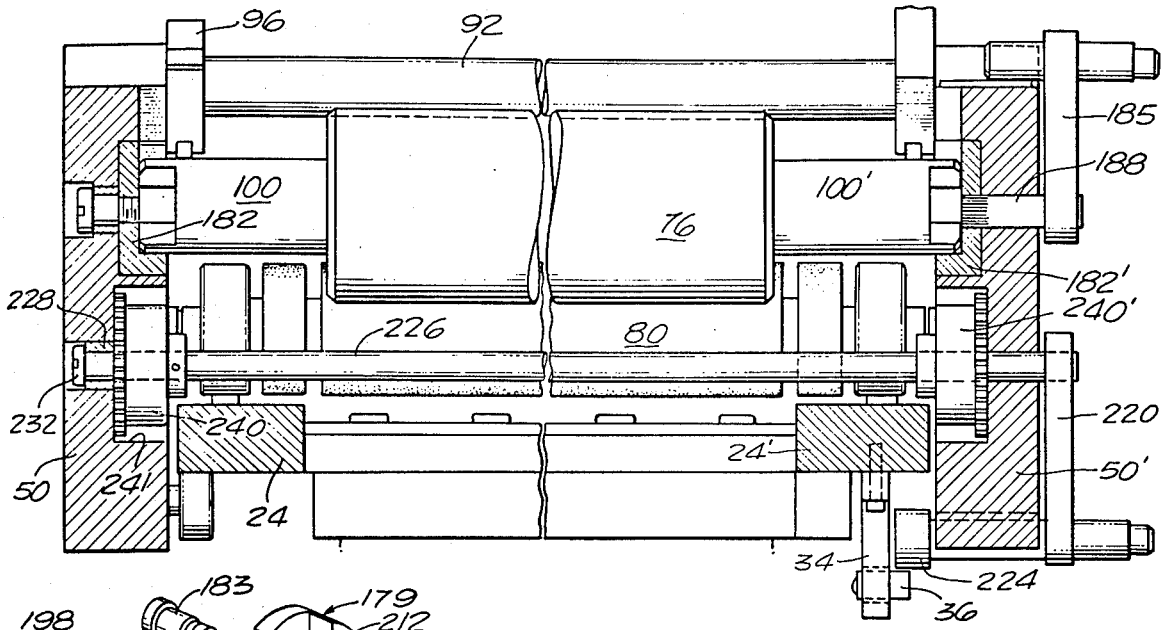
FIG. 6 is a view partly in section taken along line 6—6 of FIG. 4.

Summarizing, as shown in FIGS. 10 and 11, shoes, teeth or wedge members 164′ and 167′ on radical surfaces of rotor 140′ and 160′ interengage with each other. Therefore, as can be seen, roller 140 is always in positive driving engagement so as to drive roller 160′ and the impression roller. By rotating shaft 85′, the relative angular position of shaft 156′ is adjusted so that the height of the impression roller over the bed is adjusted as described. These adjustments can be made while the rollers are in positive driving engagement. Positive driving engagement is possible because the shoes or wedges have radial sides and they can move relatively in radial directions while remaining in driving engagement.

INKING ROLLER, OSCILLATING ROLLER AND DOCTOR ROLLER ASSEMBLY

The details of the inking roller assembly along with the oscillating roller and the doctor roller are shown in detail in FIGS. 2, 3, 4, 6, 8 and 9. FIG. 3 shows the construction on the inside of the side plate 50′. FIG. 4 is a sectional view spaced inwardly from the side plate 50 showing the relative positions of these various rollers.

The oscillating roller 76 has end shafts 167 and 167′. The inking roller 78 has end shafts 168 and 168′. The inking roller 80 has end shafts 169 and 169′. The doctor roller 82 has end shafts 170 and 170′. All of these rollers are mounted in between the side plates 50 and 50′ of the carriage 48. An arrangement of slots or channels is provided on the insides of the side plates 50 and 50′ to receive the ends of the shafts of the rollers. These slots or channels on the inside of the side plate 50 may be seen in FIG. 1 and more in detail particularly in the cross-sectional views FIGS. 3 and 4. They are alike of course in the side plates. Numeral 171 designates a Y channel on the inside of the side plate 50 having leg parts 172 and 173 and an upper channel part 174. Provided also are circular recesses 175 and 176 connected by channel recess 177. Another slot or channel is provided as shown at 178.

The end shafts on the inking rollers 78 and 80 are positioned in their respective positions by placing the shaft ends of these rollers in the vertical legs 174 and 174′ of the Y slots 171 and 171′ on the inside of the end plates 50 and 50' and then the ends of these shafts come down onto adjustable eccentric cams as will be described presently.

Figure 8:
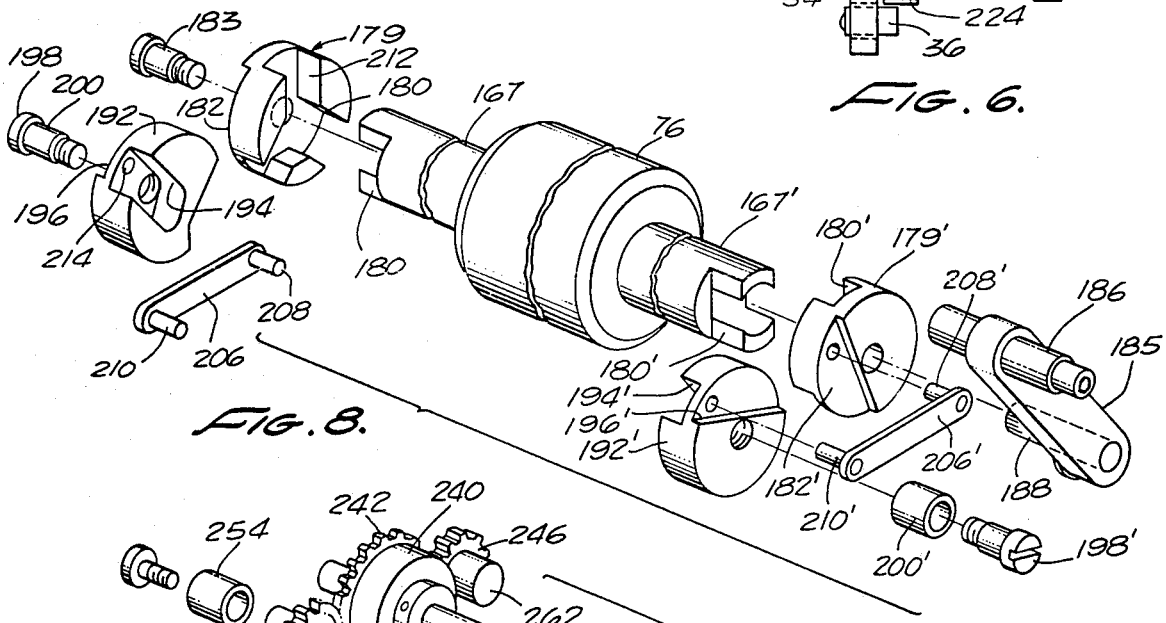
FIG. 8 is an exploded perspective view of the inking roller and doctor roller tumbler assembly.
Figure 9:
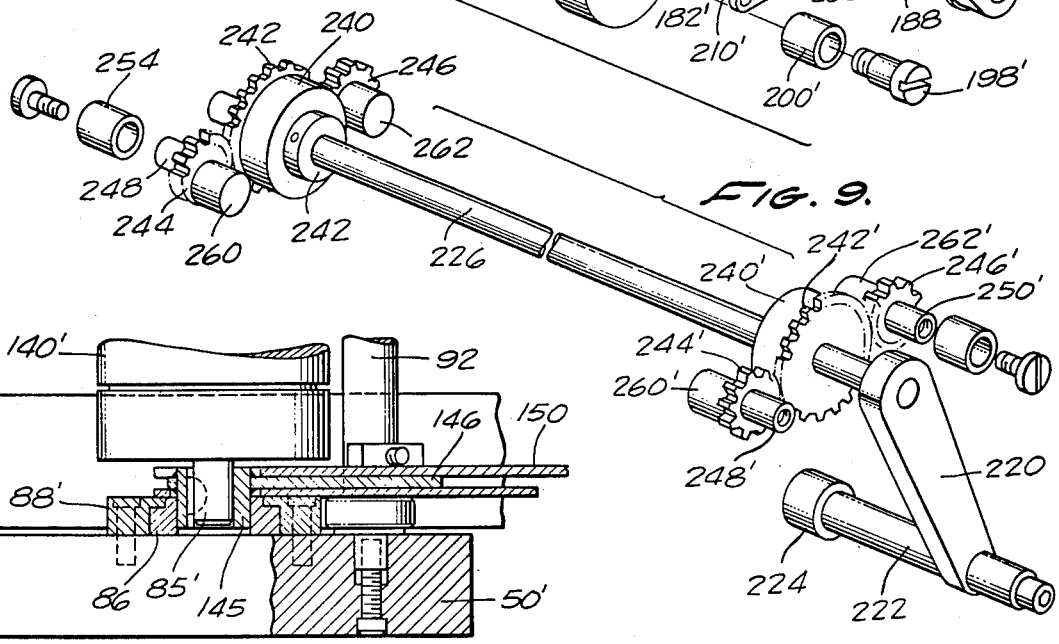
FIG. 9 is a perspective view of the drive for positioning the inking rollers.

Fitting in the circular recesses 175 and 175' are circular tumblers 179 and 179' as shown more in detail in the perspective view FIG. 8. The inside surface of the tumbler 179 is slotted as designated at 180 and the slot corresponding in shape to the part of the Y slot 171 where the legs join the stem of the Y. The tumbler 179' is of similar construction and as will be described these tumblers can be positioned in respect to the Y slots to allow the ends of the respective shafts as described to pass through the slotted tumblers into position. They will be described more in detail presently. The end part 167 of shaft of the oscillating roller 76 is flattened as shown at 180 and the other end part is similarly flattened as shown at 180'. The oscillating roller end parts fit into the tumblers 179 and 179' so that these end shafts are rotated with the tumblers.

The oscillating roller is a conventional type provided with mechanism to cause it to oscillate axially in order to uniformly distribute the ink on the inking rollers.

The outside of the surface of the tumbler 179 is cut away along a chord as shown at 182 and tumbler 179' is similarly cut away as shown at 182'. The tumbler 179 is attached to the shaft end 167 by a screw 183.

Numeral 185 designates a crank on shaft 188 and having a handle part 186. This shaft is journaled in side plate 50'. Tumbler 179' is on this shaft and it fits into the bore in end shaft 167' of oscillating roller 76. Crank 185 will be referred to again presently.

In the recess 176 is another tumbler 192, there being a similar tumbler 192' in the recess 176'. The tumbler 192 has a radial slot 194 and part of its outside surface is cut away as designated at 196. It is journaled on a screw 198 which extends through the side plate 50 the screw having a bushing 200 on it. The tumbler 192' is of corresponding construction.

The tumblers 192 and 192' can be positioned in their recesses so that the slots 194 and 194' are positioned to receive the ends 170 and 170' of the doctor roller 82 these ends being positioned through the slots or channels 178 and 178'.

The tumblers 179 and 192 are linked together by link 206 having end pins 208 and 210 that fit into apertures 212 and 214 in the respective tumblers. The tumblers 179' and 192' are linked together by a corresponding link 206'. The cut away surfaces on the tumblers as previously described accommodate the links. As will be understood, when the crank 185 is operated all four tumblers move angularly together by reason of the links 206 and 206'. By swinging the crank 185 the tumblers can be rotated in a manner such as to lift the oscillating roller and doctor roller as will be described more in detail presently. These rollers are lifted in this manner to an inactive position overnight to prevent pressure on the inking rollers causing a permanent set.

As previously mentioned the end shafts of the inking rollers rest on adjustable eccentric cams whereby these rollers can be raised and lowered. The mechanism for raising and lowering the inking rollers is shown more in detail in FIG. 9. Numeral 220 designates a crank having a handle 222 on the end of which is a roller 224. Crank 220 is on shaft 226 which journals in the side plates 50 and 50' as may be seen in FIG. 6 the left end of the shaft being within bushing 228 in bore 230 in end plate 50, securement being by way of screw 232. See FIG. 6.

On the shaft 226 is a drum 240 having gear 242 secured by collar 242. It is in cutout 241 in plate 50. At the other end of the shaft is similar drum 240' and gear 242'. Gear 242' meshes with smaller gears 244' and 246' there being two similar gears as shown meshing with the gear 242. Gears 244' and 246' are on shafts 248' and 250' which are journaled in the side plate 50'. As may be seen in FIG. 2 shaft 248' is journaled in a bushing and 228' in bore 230' in the end plate 50'. Carried on the gear 248' is an eccentric cam 260' and carried on the gear 246' is a similar eccentric cam 262'. As may be seen by turning the crank 220 through an angle the gears 242 and 242' are driven so as to drive the smaller gears that they mesh with moving the eccentric cams 260, 260', 262 and 262' as to lift the ink rollers 78 and 80, the shaft ends, 168, 168', 169, and 169' resting on the cams as seen in FIG. 3.

When the carriage 48 is moved to the left end of its travel, roller 224 on the handle of crank 220 can engage the cam member 36 to trip the handle 220, that is, to move it through an angle so as to drive the gears 242 and 242' to lift the ink rollers from inking position. As shown in FIG. 1 cam members 262 and 262' are provided on rails 24 and 24' so that when the carriage is at the left end of its travel the rollers 140 and 140' ride upon these cams thus lifting the impression roller off the card stock.

The inking rollers can be rotated by inserting the crank 263 through the hole 264 in the side plate 50' to engage one of the ink rollers for turning it sufficiently to ink it.

Numeral 280 designates a tray attachable to the carriage 48 for feeding in the card stock. It has angular side members 282 and 282' and extending mounting brackets 284 and 284' which are bent so that the tray is offset slightly to one side. As may be seen the bracket 284 has an end notch 286 and a notch on its lower side 288. Notch 286 straddles or engages the shaft 85 of the impression roller as shown and the notch 288 seats on the spacer shaft 52 as shown and the tray is adjustable by adjusting screws as shown at 292 in FIG. 4 in bracket 294. Extending between the bracket pieces 284 and 284' is a rod 296 and mounted on it are adjustable holder shoes 298 and 298 carried by bushings 300 and 300' adjustable on rod 296 by screws as shown.

Numeral 301 designates a locking latch positionable to lock lever 185 in inactive position or to release it for positioning to active position as previously referred to.

Means are provided to clamp the card stock against the bed of the machine when it is placed in position from the tray 280. The clamping means is operated by a foot pedal not shown connected to a chain 310 as may be seen in FIGS. 1 and 4. This chain is connected to a lever 312 having an angular end part 314 and foot 315 as may be seen in FIG. 4. Numeral 316 designates an angular channel member having a part positioned adjacent the end of the bed of the machine by screw 318. Numeral 320 designates a gripper bar extending through the channel member 316 and engagable with the foot part 315 and having coil spring 322 urging it against member 316. Chain 310 is connected to the foot pedal and when it is pressed the lever 312 is rotated to cause the foot to release the gripper and the gripper re-engages whenever the foot pedal is released. Gripper member 320 serves to grip and hold the end of the card stock.

OPERATION

From the foregoing those skilled in the art will readily understand the operation of the machine. It may be summarized as follows however:

Locking latch 301 is rotated to its center position and the activating handle 185 is then moved to the operating position. The locking latch is then moved to the operating position. The inking rollers are moved to the up position by rotating the crank 220 to the position of the notch in the side plates. Then the head or carriage 48 is moved on the machine to its leftward position against the stops. A large piece of type may then be placed on the bed of the machine and a piece of card stock of the thickness or ply to be used is placed on top of this piece of type. The carriage assembly is then moved to the right until the impression roller 74 is directly over the large piece of type. The knob 152 is then loosened and arm 146 is then moved adjacent to the indicator plate until a slight resistance is felt and then the clamp is tightened. The head or carriage assembly 48 is then moved to the left-hand position.

Ink is then applied to the large oscillating roller 76. Crank 263 is inserted through the hole in the side plate 50' to engage the inking roller. A limited amount of continuous cranking is sufficient to fully distribute the ink on the doctor roller and the ink roller.

The carriage 48 is then moved to the right-hand end of the machine where the ink rollers will automatically drop into inking position. Crank 220 engages dog 38 to do this. The operating handle 94 is then pulled to the left to bring the impression roller into position and the carriage assembly is moved back to the left end of the machine. The stops on the feed tray 280 are then set to the desired width of card stock and the foot pedal is pushed to open the gripper clamps and the card stock is inserted the foot pedal being immediately released so that the card stock is gripped. Operating handle 94 is then moved to the right so as to apply the pressure by the impression roller and the carriage assembly is moved to the right-hand of the machine at which time the printing takes place.

From the foregoing those skilled in the art will fully understand the nature of the machine and its operation and the manner in which it achieves and realizes all the objects as set forth in the foregoing.

The foregoing disclosure is representative of a preferred form of the invention and is to be interpreted in an illustrative rather than a limiting sense and the invention be accorded the full scope of the claims appended hereto.

What is claimed is:

1. A printing machine having a type holding bed with rails extending along the sides of the bed, a carriage movable along the rails, the carriage having side plates and carrying at least one inking roller mounted about a shaft for applying ink on said bed and an impression roller between the plates to be movable with the carriage, the improvement comprising eccentric cam means rotatably mounted on the side plates; the inking roller having shaft ends resting on the peripheries of said eccentric cam means, and means for rotating said eccentric cam means to raise and lower said inking roller, relative to the bed.

2. A machine as in claim 1 wherein said side plates have slots formed therein in which are received the shaft ends of the inking roller the slots being situated for positioning the inking rollers with said shaft ends on said eccentric cam means.

3. A machine as in claim 2, wherein there are two inking rollers and two eccentric cam means, the said slots being of inverted Y shape, said eccentric cam means being positioned at the ends of the slot portions which are the legs of the Y.

4. A machine as in claim 3, wherein said side plates have circular recesses, circular tumblers rotatably positioned in the side plates, said tumblers having slots therein receiving the shaft ends and being positionable so that said slots align with said slots in the side plates to allow passage of said shaft ends.

5. A machine as in claim 4, including an oscillating roller on a shaft and positioned for distributing ink on the inking rollers, said slots in said tumblers receiving the shaft ends of the oscillating roller in an eccentric position relative to the axes of the tumblers with the oscillating roller tangent to an inking roller whereby the tumblers are rotatable so as to lift the oscillating roller relative to the said inking roller.

6. A machine as in claim 1, including drive rollers movable on the rails and having clutching engagement with the impression roller for driving it.

7. A machine as in claim 6, including a shaft having an eccentric part carrying said impression roller and having end parts, and means whereby the shaft can be moved for adjusting the vertical position of the impression roller.

8. A printing machine having a type holding bed with rails extending along the sides of the bed; a carriage movable along the rails, the carriage having side plates and carrying inking roller means and an impression roller between the sides to be cooperable with the bed, an oscillating roller having shaft ends which is engageable with the inking roller means, the improvement comprising side plates having circular recesses therein; and circular tumblers positioned in said recesses, said tumblers receiving the shaft ends of the oscillating roller in an eccentric position whereby said tumblers are rotatable in a manner to lift said oscillating roller from engagement with the inking means.

9. A machine as in claim 8, wherein said side plates have an additional pair of recesses, additional tumblers in said recesses, said additional tumblers eccentrically receiving the ends of a doctor roller which engages said inking rollers, and means whereby said additional tumblers are rotatable to lift the doctor roller to disengage it from the inking rollers.

10. A machine as in claim 9, including linkage means between the first mentioned tumblers and the additional tumblers whereby all tumblers can be simultaneously rotated.

11. A machine as in claim 8, wherein said side plates and said circular tumblers have slots formed therein, the slots in the tumblers being positionable to align with said slots in the side plates whereby shaft ends of the inking roller means can be passed downwardly through the slots for positioning the inking rollers in inking position.

12. A machine as in claim 11, including eccentric cam means carried by the side plates in a position to have shaft ends of inking roller shafts carried thereon.

13. A printing machine having a type-holding bed with rails extending along the sides of the bed, a carriage movable along the rails, the carriage having side plates and carrying inking roller means for applying ink to said type and an impression roller between the side plates for movement along the bed, the improvement comprising eccentric cam means rotatably mounted on the side plates, the inking roller means having shaft end parts resting on the peripheries of said eccentric cam means, and means for rotating said eccentric cam means to raise and lower said inking roller means, relative to the bed, said side plates having slots formed therein in which are received the shaft end parts of the inking roller means, the slots being situated for positioning the inking roller means with said shaft end parts on said eccentric cam means; said slots in said side plates being of inverted Y-shape, said eccentric cam means being positioned at the ends of the legs of the Y, said side plates having circular recesses, circular tumblers rotatably positioned in said recesses, said tumblers having slots therein and so positioned that said slots align with said slots in the side plates, an oscillating roller, said slots in said tumblers receiving shaft ends of the oscillating roller in an eccentric position relative to the axes of the tumblers and positioning said oscillating roller in engagement with said inking roller means, whereby the tumblers are rotatable to lift the oscillating roller from the inking roller means, said side plates having an additional pair of circular recesses opposite each other, additional circular tumblers rotatable in said additional recesses, said additional tumblers having slots, a doctor roller, said doctor roller having shaft ends received in the slots in the additional tumblers in eccentric relation to the axes of said additional tumblers and engaging said inking roller means, said additional tumblers being rotatable to lift the doctor roller from said inking roller means.

14. A machine as in claim 13, including linkages connecting the first mentioned tumblers and the additional tumblers, and means whereby all tumblers can be simultaneously rotated for moving the oscillating roller and doctor roller out of engagement with the inking roller means.

* * * * *